US005447666A

United States Patent [19]

LaFontaine

[11] Patent Number: 5,447,666

[45] Date of Patent: Sep. 5, 1995

[54] METHOD OF FORMING RADIANT FIBER BURNER

[75] Inventor: Robert D. LaFontaine, Ajax, Canada

[73] Assignee: Canadian Gas Research Institute, Don Mills, Canada

[21] Appl. No.: 154,572

[22] Filed: Nov. 19, 1993

Related U.S. Application Data

[63] Continuation-in-part of Ser. No. 885,787, May 20, 1992, abandoned.

[51] Int. Cl.[6] ..... B28B 1/26

[52] U.S. Cl. ..... 264/62; 264/87; 264/156

[58] Field of Search ..... 431/326, 328, 329, 7, 431/170; 264/62, 63, 66, 156, 155, 67, 86, 87

[56] References Cited

U.S. PATENT DOCUMENTS

| | | | |
|---|---|---|---|
| 3,383,159 | 5/1968 | Smith et al. | 431/328 X |
| 4,174,954 | 11/1979 | Küsebauch et al. | 48/212 |
| 4,673,349 | 6/1987 | Abe et al. | 431/328 |
| 4,746,287 | 5/1988 | Lannutti | 431/32 X |
| 4,899,696 | 2/1990 | Kennedy et al. | 431/328 X |

FOREIGN PATENT DOCUMENTS

| | | | |
|---|---|---|---|
| 645925 | 7/1962 | Canada | 431/328 |
| 8301459 | 11/1984 | Japan | 431/328 |
| 2223708 | 9/1990 | Japan | 431/328 |

OTHER PUBLICATIONS

Industrial applications of the radiant ceramic fiber burner by Schreiber et al., 1983 International Gas Research Conference.

*Primary Examiner*—Christopher A. Fiorilla
*Attorney, Agent, or Firm*—Bereskin & Parr

[57] ABSTRACT

A method of forming a burner for a gaseous mixture of fuel and an oxidant mixes a random mix of refactory fibers, the fibers being predominantly alumina and silica, and then forms a burner body from the fiber mix. Passageways are then formed in the burner body by perforating the burner body with pins. This is achieved by providing comb assemblies each having a plurality of pins, which are pressed into the body from either side and then removed, and the body is then indexed for further sets of holes to be formed. The burner body can be treated with colloidal silica and subsequently baked to bond and preshrink the fibers, both before and after the forming of ports or passageways.

18 Claims, 5 Drawing Sheets

METHOD OF FORMING RADIANT FIBER BURNER

CROSS-REFERENCE TO RELATED APPLICATION

This application is a Continuation-in-Part of earlier application Ser. No. 07/885,787 filed May 20, 1992 now abandoned.

FIELD OF THE INVENTION

The present invention relates to a radiant burner for the combustion of gaseous fuel/oxidant mixtures, and more particularly to a method and apparatus for production of such a burner.

BACKGROUND

The combustion of gaseous fuels requires mixing of the fuel gas with a source of oxidant. This source of oxidant is most commonly normal ambient air. "Oxygen-enriched" air is also obtainable by a variety of methods in known manner. Each gaseous fuel has lower and upper flammability limits which define the minimum and maximum fuel content of the fuel/oxidant mixture in order for combustion to occur. Depending on the gaseous fuel and the fuel concentration of the fuel/oxidant mixture, the resulting flame will possess a characteristic flame speed. The flame speed is the velocity at which the flame will propagate towards the source of the fuel/oxidant mixture supply. A stable flame front (i.e., leading edge of the flame) is established, when the velocity of the fuel/oxidant supply equals the flame speed.

The propagation of a flame front depends on the leading edge of the flame being able to raise the temperature of the fuel/oxidant mixture through which it is propagating to a minimum temperature (ignition temperature) in order for the chemical reaction of combustion to occur. If unable to continually raise the fuel/oxidant mixture to the ignition temperature, the flame front will establish itself at a point where it was last able to achieve the required temperature rise of the fuel/oxidant mixture.

The purpose of a "premix" burner is to provide a controlled flow of fuel/oxidant mixture to the area intended for the combustion process (flame zone). When the flow rate of the fuel/oxidant mixture through a burner reduces, the port velocity reduces. This typically causes the flame front to establish itself closer to the actual burner port(s). As the flame front anchors closer to the burner port(s), thermal energy from the base of the flame will heat up the material forming the burner port(s). The temperature resistance of the burner port material therefore is one limiting design feature for establishing a minimum allowable port velocity. When flame speed exceeds port velocity, the flame front will attempt to propagate through the burner port(s). Energy absorbed by the burner port material tends to "quench" the flame front. If the flame front can raise the fuel/oxidant mixture to ignition temperature despite the quenching effect of the port material, the flame might propagate through the port(s) and ignite the fuel/oxidant mixture upstream of the burner port(s). This undesirable condition is called flashback or pre-ignition. This condition can also occur if the burner port material itself gets hot enough to ignite the fuel/oxidant mixture upstream of the burner port(s). These design limitations restrict the ability of burners to accommodate a large turndown ratio (i.e., fuel input range), and hence, operating range for the burner.

Many conventional burners are not intended to operate as radiant bodies. Such burners are often formed from steel either with slot-shaped or circular ports. As such, they produce hot combustion gases, with insignificant radiant heat.

Radiant burners are preferred for a number of applications. They have the advantage of maintaining a lower flame temperature and hence, reducing the production of nitrous oxides.

Burners intended to be capable of operation as radiant bodies exist in a variety of forms, for example: solid clay ported ceramics manufactured by Hamilton Procelains and Schwank; fibrous permeable matrices manufactured by Alzeta Pyrocore and A. O. Smith.

The solid clay ported types are restricted to low levels of energy per unit surface area, are not capable of wide input rate turndown and possess relatively high thermal conductivity conducive to pre-ignition if overheated. They are therefore typically used for fixed input burners for use in open atmosphere.

The fibrous permeable matrix types allow the fuel/oxidant mixture to permeate only through the matrix of fibers. Therefore these types operate in a predominantly subcutaneous combustion mode. They possess only modest turndown capability because of the predominance of subcutaneous combustion operation and the inherent flame quenching that occurs especially at low fuel input rates. They can also suffer from extraordinary fuel and/or oxidant filtration requirements to prevent clogging.

U.S. Pat. No. 4,673,349 (Abe et al.) discloses a high temperature surface combustion burner plate made from a ceramic porous body with a plurality of throughholes. However, little teaching is given on the formation of the throughholes, and it simply refers to forming these either by pins during the molding, or subsequently by drilling.

Neither technique provides a satisfactory method for the quick, economic production of burners. Pins can become stuck in the burner or rupture it during removal, while drilling is very time-consuming. What is therefore desired is a method of manufacturing a burner capable of withstanding elevated temperatures so as to act as a radiant body which method is simple and reliable. The burner should possess a low thermal conductivity yet have sufficient flame thermal quenching characteristics to minimize or eliminate flashback/pre-ignition. The method should provide passageways which are not prone to clogging so as to only require reasonable filtration. The method should enable burners of a variety of shapes or dimensions to be produced to accommodate scaling of energy input range or adaptation to various combustion chamber orientations. The burner should be economical to produce.

SUMMARY OF THE PRESENT INVENTION

In accordance with the present invention, there is provided a method of forming a burner for a gaseous mixture of a fuel and an oxidant, the method comprising:

(a) forming a random mix of refractory fibers, which preferably comprise predominantly alumina and silica;

(b) forming a burner body of a predetermined shape including an inlet for a fuel and oxidant mixture;

(c) optionally treating the burner blank with colloidal silica and subsequently baking the burner blank to bond and preshrink the fibers; and (d) forming passageways in the burner blank by perforating the burner body with a pin.

The body of the burner can be initially fabricated by a known method, preferably slurry vacuum forming. The fibers can comprise any suitable ceramic or refractory fibers, capable of bonding to form a rigid body capable of withstanding temperatures encountered in use. Further, the fibers should be capable of forming a body that permits permeation of gas through interstices of the fibers. The body should be sufficiently rigid and strong that ports or passageways can be formed by perforation with no significant damage to the body; this encompasses fiber compositions that may require subsequent treatment, e.g. with colloidal silica, before forming the ports. A chemical analysis of the initial fabricated body is typically represented by a percentage by weight analysis as follows:

| | | |
|---|---|---|
| Ferric Oxide | FeO3 | 0.53–0.97 |
| Titanium Oxide | TiO2 | 0.70–1.27 |
| Magnesium Oxide | MgO | Trace |
| Calcium Oxide | CaO | 0.04–0.07 |
| Alkalies as | Na2O | 0.08–0.15 |
| Boron Oxide | B2O3 | 0.03–0.06 |
| Organics | | 1.36–2.47 |
| Alumina and Silica | | Balance |

The organic catalyst outgasses at temperatures about 300° F. (149° C.) while complete elimination of organic material is realized by baking at 1,000° F. (538° C.) or more. These fibers are capable of continuous use at temperatures up to 2,250° F. (1232° C.) and exhibit excellent thermal shock characteristics up to 3,100° F. (1,704° C.) which is the nominal melting point. The fibers appear white to cream in color. Thermal conductivity (BTU/Hr/FT2/degreeF/inch of thickness) nominally ranges from 0.49 at 600° F. to 1.23 at 1,800° F. (10.9 at 316° C. to 27.5 at 982 C kW/cm$^2$/C/cm of thickness).

Treatment with a solution of up to 20% colloidal silica for rigidizing, and baking at a nominal 2,000° F. (1,093° C.) temperature or higher for fiber bonding and preshrinking, is included in the fabricating process for this composition. Linear shrinkage ranges from 1.0 to 2.6 percent depending on initial fiber density and baking temperature. At this stage the fiber matrix embodiment is described as a "burner blank".

The burner blank is subjected to a subsequent fabrication method to form ports for passage of the fuel/oxidant mixture through the fiber matrix of the material. These ports are the primary passages with some permeation of the fuel/oxidant mixture occurring within the matrix. Sizing and spacing of these ports can vary to suit the application.

While individual steps of the method may be known, the combination of these steps produces a burner blank possessing the physical and mechanical properties necessary for compatibility with the port forming method. The combination of specifications also produces a fiber matrix of suitable flame quenching characteristics so as to provide a burner which is flashback/pre-ignition resistant when proper port sizings are incorporated. If the fibers are not properly treated during the primary fabrication of the burner blank, the desired process of port formation will not be achievable, and various failure modes would occur during port formation.

The physical size of the burner will be determined by the combustion chamber into which it is to be used, the fuel input, and the port loading capabilities of the burner. The port loading is dependent on the fuel/oxidant mixture being used.

Inadvertent damage to the fiber matrix after final fabrication of the burner head can be repaired provided the damage is limited and localized. A method of repair, which forms part of the present invention, comprises applying a localized wetting of colloidal silica or the mixing of preshrunk fibers with a solution of colloidal silica and applying the mixture as a filler depending on the degree and depth of damage to the fiber matrix. Air drying of the colloidal silica solution is adequate. Silica crystals will bond the fibers as the aqueous solution evaporates. These silica crystals tend to increase local density and reduce inter-fiber spaces thereby reducing localized permeation of the fuel/oxidant mixture with a characteristic reduction in localized subcutaneous combustion and radiative emission.

Preferably, the burner body or blank is perforated by means of a comb assemblies, each of which comprises a plurality of parallel pins. For a cylindrical burner body, the comb assemblies would be aligned parallel to the axis of the cylinder and pressed into the cylinder, from generally diametrically opposite positions. The comb assemblies can then be withdrawn, and the cylinder indexed through a predetermined angle, to enable the operation to be repeated. By repeating the steps, the entire cylindrical surface of the burner body or blank can be perforated. Further, one set of pins can be axially and circumferentially offset or staggered relative to the other, to give a staggered array of ports, where desired.

Advantages of the present invention are:

(a) a high degree of resistance to flashback/pre-ignition is obtained even in modulated operation over a wide range of fuel/oxidant proportions and volumetric flow rates;

(b) the formation of relatively large ports (compared to inter-fiber spaces) through the fibrous matrix minimizes susceptibility to clogging thereby minimizing filtration requirements;

(c) the material of the present invention, when prepared to the specifications cited, enables the machining of ports or the forming of ports by a perforating process which results in a low cost burner;

(d) the material of the present invention is capable of withstanding elevated temperatures enabling it to act as a radiant body which when created behind the flame envelope produces a more luminous flame which enhances radiative energy transfer from the flame;

(e) the porous inter-fiber space permits permeation of the fuel/oxidant mixture thereby obtaining partial subcutaneous combustion to create a radiant surface and an ionized ground plane for the adaptation of electronic flame rectification safety control systems;

(f) the thermal insulating characteristic of the fiber matrix maintains low interior burner head surface temperatures enabling simple and low cost means of attachment of the burner to the fuel/oxidant supply system;

(g) the fabricating methodology results in a cost-effective burner providing unique characteristics compared to other radiant burners currently available; and (h) the fibrous matrix can be field-repaired if limited localized damage to the fiber-to-fiber bonds occurs.

BRIEF DESCRIPTION OF THE DRAWING FIGURES

For a better understanding of the present invention and to show more clearly how it may be carried into effect, reference will now be made, by way of example, to the accompanying drawings in which:

FIG. 1 is an isometric view showing one embodiment of the fiber burner;

FIG. 2*a–c* shows various port arrays;

FIG. 3 shows an internal support baffle for mounting longer burners in a horizontal position; and FIG. 4 shows a front view of an apparatus for forming passageways in the burner; and FIG. 5 is an electrical schematic of a control circuit of the apparatus of FIG. 4.

DESCRIPTION OF THE PREFERRED EMBODIMENT

Figure 1:
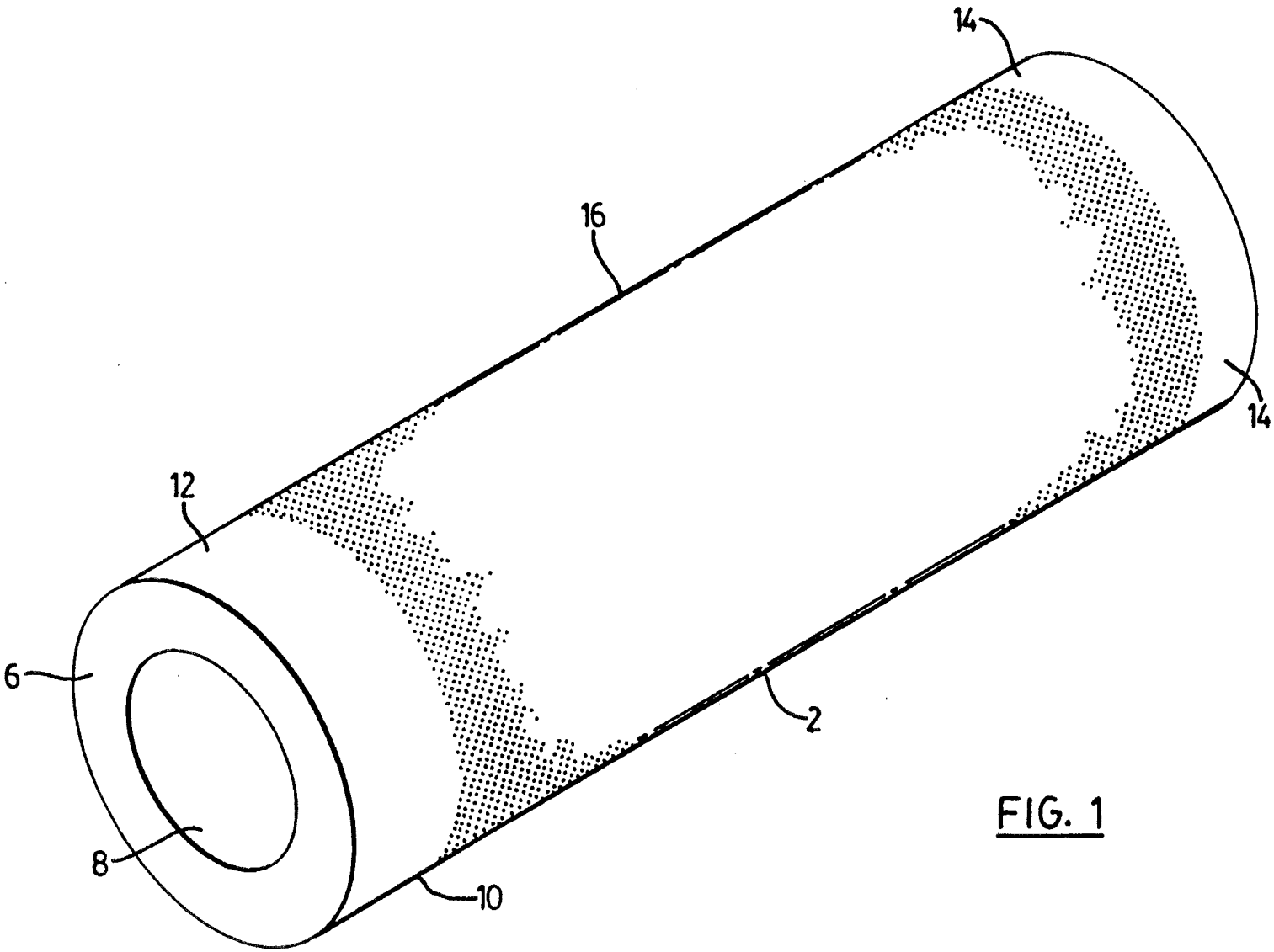

The burner 2 is in the form of a cylinder with one closed end 4 and another open end 6, forming an inlet for a gas/air mixture. The cylinder has an internal cylindrical wall 8, and an external cylindrical wall 10. The closed end wall has a similar thickness to the cylindrical sidewall. At either end, there are an inlet end portion 12 and an outlet end portion 14, which are left unperforated. A main, central portion 16 of the cylinder is perforated to incorporate ports through the cylinder wall, as shown. The inlet end portion 12 facilitates mounting to a fuel/oxidant supply system by suitable means and provides for offsetting the flame zone from the mounting arrangement by a desired amount.

The burner body is formed from bonded refractory fibers, predominantly alumina and silica, although Kaolin fibers may alternatively be used. The body of the fiber matrix is initially fabricated by a common method known as a slurry vacuum forming, into the desired burner shape. A chemical analysis of the initial fabricated body is typically represented by a percentage by weight analysis and is as follows:

| | | |
|---|---|---|
| Ferric Oxide | FeO3 | 0.53–0.97 |
| Titanium Oxide | TiO2 | 0.70–1.27 |
| Magnesium Oxide | MgO | Trace |
| Calcium Oxide | CaO | 0.04–0.07 |
| Alkalies as | Na2O | 0.08–0.15 |
| Boron Oxide | B2O3 | 0.03–0.06 |
| Organics | | 1.36–2.47 |
| Alumina and Silica | | Balance |

The organic catalyst outgasses at temperatures about 300° F. (149° C.). Here, the organic material is completely eliminated by baking at 1,000° F. (538° C.) or more. These fibers are capable of continuous use at temperatures up to 2,250° F. (1232° C.) and exhibit excellent thermal shock characteristics up to 3,100° F. (1,704° C.) which is the nominal melting point. The fibers appear white to cream in color. Thermal conductivity (BTU/Hr/FT2/degreeF/inch of thickness) nominally ranges from 0.49 at 600° F. to 1.23 at 1,800° F. (10.9 at 316 C to 27.5 at 982 C kW/cm$^2$/C/cm of thickness).

The fibers are treated with a solution of up to 20% colloidal silica for rigidizing, and are then baked at a nominal 2,000° F. (1,093° C.) temperature or higher for fiber bonding and preshrinking. This treatment has been found essential for fibers of the above composition, as otherwise the fibers are too soft for the ports or passageways to be formed reliably. These steps are included in the primary fabricating process. Linear shrinkage ranges from 1.0 to 2.6 percent depending on initial fiber density and baking temperature. At this stage the fiber matrix is described as a "burner blank".

The burner blank is then subjected to a subsequent fabrication method to form ports for passage of the fuel/oxidant mixture through the fiber matrix of material.

The ports are formed by a punching operation, as detailed below. Where a punching operation is used, a sharp or needle-shape punch is used, which effectively displaces the fibers of the burner body to the side, rather than punching out a cylindrical plug of material.

The ports are the primary passages with some permeation of the fuel/oxidant mixture occurring within or through the matrix. Sizing and spacing of these ports can vary to suit the application. Embodiments to date have incorporated round ports with diameters ranged from 0.055 to 0.099 inch (1.4 to 2.5 mm) and a version with linear slot port widths of 0.125 inch (3.2 mm).

The spacing of ports is typically on a staggered array when utilizing round ports.

Figure 2A:
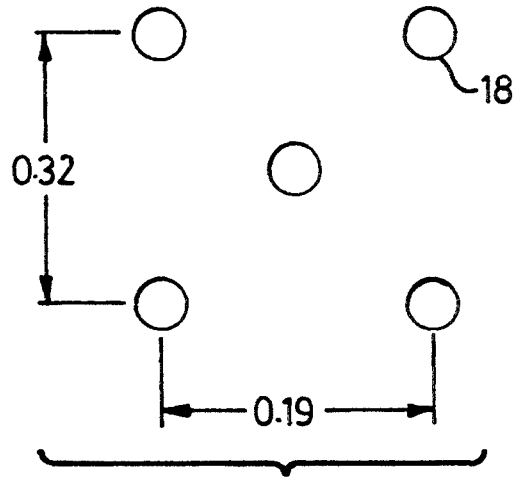
Figure 2B:
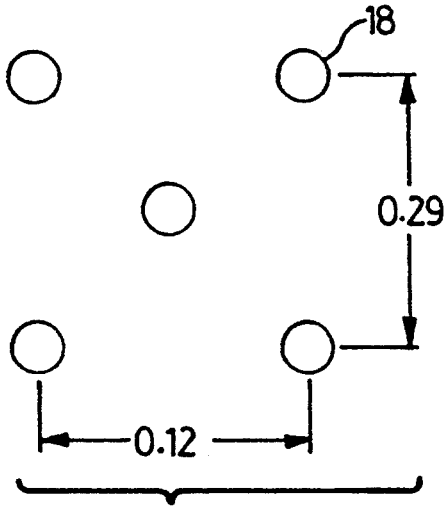
Figure 2C:
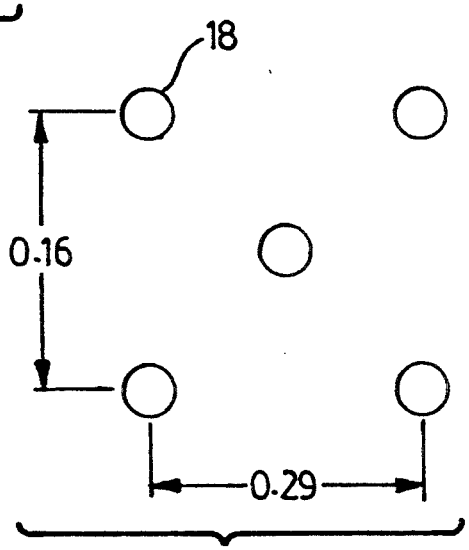

FIG. 2 shows a variety of different port arrays with the ports denoted 18. In FIG. 2*a*, the ports have, as shown, a horizontal spacing of 0.19 inches in each row, and a vertical spacing, between alternate rows of 0.32 inches. In FIG. 2*b*, the spacing in each row is reduced to 0.12 inches, and alternate rows are now spaced by 0.29 inches. Finally, the version as shown in FIG. 2*c* has a port spacing in each row of 0.29 inches, and the spacing between alternate rows of 0.16 inches. The spacing should be chosen to give the desired gas flow characteristics. Further the ports should be sufficiently far apart that the burner blank does not suffer significant damage during the port forming operation.

In an alternative arrangement, each port has a size of nominally 1/16 inch (1.6 mm) diameter. Spacing between ports in the same lateral or axial row is nominally 9/32 inch (7.1 mm) with staggered lateral rows of ports offset axially by nominally 9/64 inch (3.6 mm). Radial spacing between staggered rows is nominally 1.5 degrees to form a uniform staggered pattern, with the radius such that the circumferentially spacing is comparable to the axial spacing. The pattern and size of ports is adaptable to variation to suit the applications. Following the formation of the ports, the burner is cleaned as far as possible of any residual dust, debris and small particles caused by the port-forming process; this is achieved by using compressed air.

Following this, there is an optional further step of treating the burner with colloidal silica, which again can comprise up to 20% colloidal silica. After soaking in the colloidal silica, the burner is then treated to a low temperature bake at 200° F. (95° C.) simply to dry the silica. The purpose of this step is to repair any minor fractures or damage caused by the port-forming process. It is also recognised that the port-forming process, despite any cleaning, may leave small particles of debris within the ports and elsewhere, which could subsequently become dislodged and block one or more ports. This treatment step is intended to secure any such debris in place, so that it cannot clog or block any ports.

In use, the burner will be subjected to temperatures well above 200° F., but still below the earlier baking temperature of 2,000° F. Such temperatures will further assist in bonding the silica to the fibers of the body.

The burner blank fabricating process thus includes a number of steps, namely:

(a) forming the basic body shape from a particular fiber density and composition;

(b) subsequent soaking treatment with a specified concentration of colloidal silica; and (c) baking at a specified minimum temperature.

The combination of these steps produces a burner blank possessing the physical and mechanical properties necessary for compatibility with the port forming method. Further, it produces a fiber matrix of suitable flame quenching characteristics so as to provide a burner which is flashback/pre-ignition resistant when proper port sizings are incorporated. If the fibers are not properly treated during the primary fabrication of the burner blank, the desired process of port formation will not be achievable. In other words, the present invention includes a certain combination of primary steps to produce burner blanks with appropriate physical and mechanical properties. Without them, the fiber-to-fiber bonds in the matrix will not have the correct properties, which will in turn lead to various failure modes during the port forming process.

As shown, the preferred embodiments of the burner are cylindrical with one closed end. Dimensions and shape are generally unrestricted subject to the application of the finished product. Embodiments to date have incorporated primary burner blank cylinder shapes with length/diameter ratios ranging from 1.5 to 2.7. Fiber wall thicknesses of 1/2 to 1 inch (1.27 to 2.54 cm) and fiber densities of nominally 14 to 28 LB/FT3 have been used.

The physical size of the burner will be determined by the combustion chamber into which it is to be used, the fuel input, and the port loading capabilities of the burner. The port loading is dependent on the fuel/oxidant mixture being used. Typical port loading parameters of the invented burner in practical use, when using Natural Gas with air as oxidant, range from 4130 to 61900 BTU/Hr/Sq.Inch (1,875 to 28,100 kW/m$^2$) of port area.

The fuel/air mixture may vary over a practical range of 6% to 9% CH4 without flashback/pre-ignition occurring.

Inadvertent damage to the fiber matrix after final fabrication of the burner head can be repaired provided the damage is limited and localized. A method of repair, which forms part of the invention, comprises applying a localized wetting of colloidal silica or the mixing of preshrunk fibers with a solution of colloidal silica and applying the mixture as a filler depending on the degree and depth of damage to the fiber matrix. Air drying of the colloidal silica solution is adequate. Silica crystals will bond the fibers as the aqueous solution evaporates. These silica crystals tend to increase local density and reduce inter-fiber spaces thereby reducing localized permeation of the fuel/oxidant mixture with a characteristic reduction in localized subcutaneous combustion and radiative emission.

Figure 3:
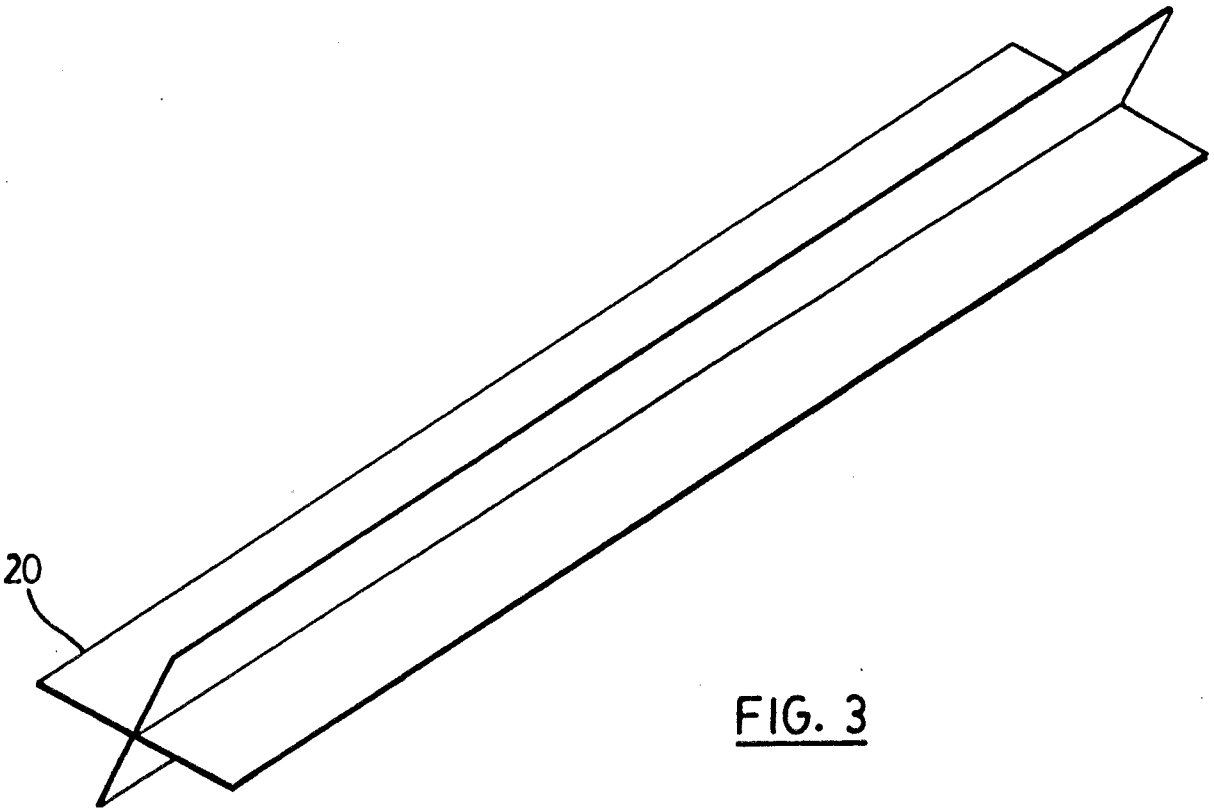

FIG. 3 shows an inner support 20 used when mounting the burner in a horizontal orientation. This support 20 is cross-shaped in section. It prevents a bending moment from imposing a tensile stress on the upper cross-section of the cylinder wall.

Figure 4:
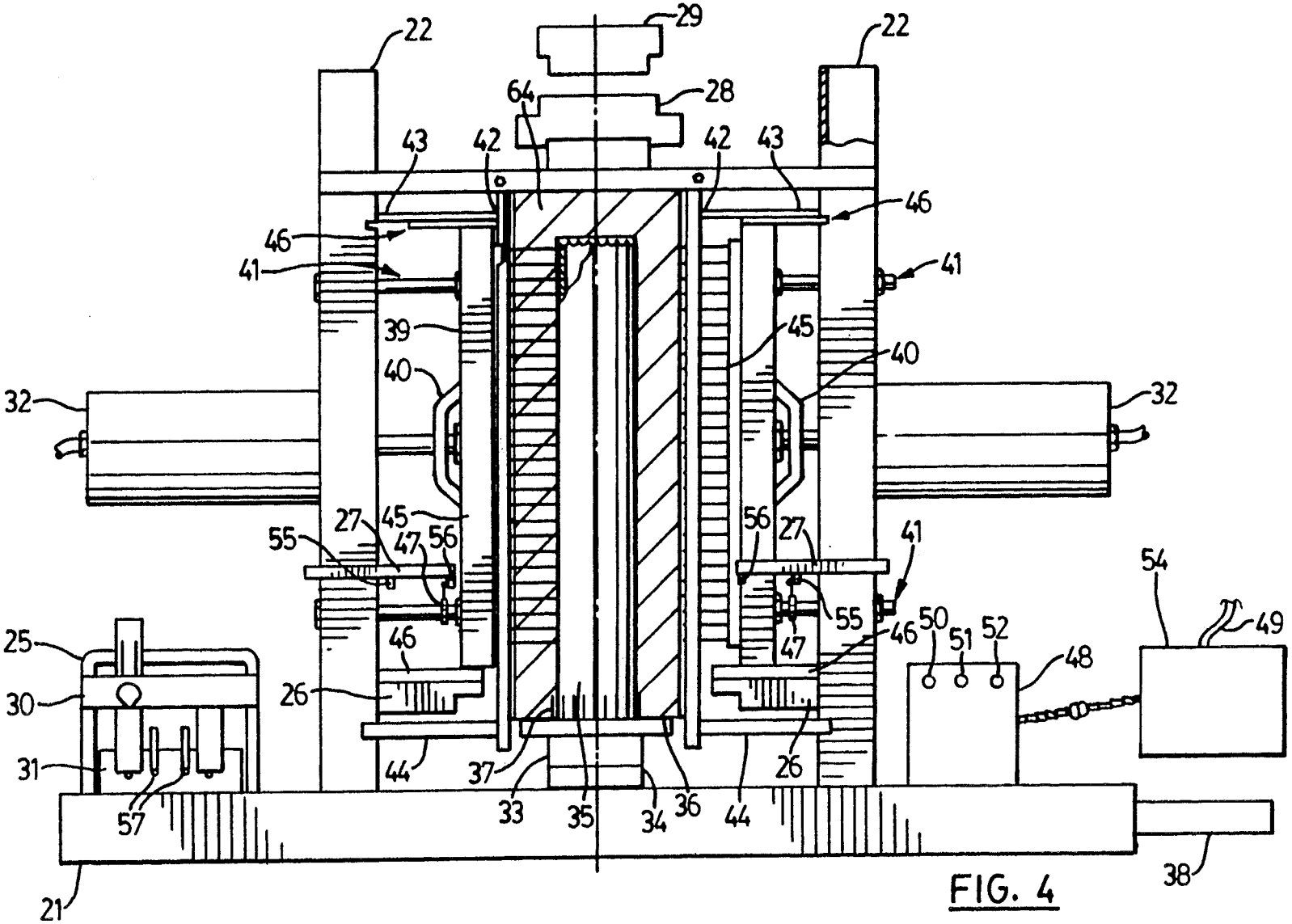

FIG. 4 shows plan views of an apparatus or perforator machine for forming the ports. In FIG. 4, the framework comprises an inverted U-section channel base 21 with two upright channel-section supports 22. Upper cross members 23 and lower cross members 24 are secured between the upright supports 22 on both the front and rear facing surfaces. Mounting brackets 25, 26, 27 are provided for attachment of other components in desired positions. An upper collar 28 is centrally mounted between the upper cross members 23. A concentrically mating weighted cap 29 is provided which fits into the upper collar 28. In FIG. 4, upper cross members 23, lower cross members 24, upper collar 28 and cap 29 are omitted for clarity.

A compressed air filter/regulator/lubricator assembly 30 is mounted on the bracket 25. An automatic air valve 31 with bleed valves 57 on each of two exhaust ports is mounted to the base 21 below and behind the assembly 30. An air cylinder 32 is mounted on each of the uprights 22. A rotary indexer table 33 with a spacer 34 is centrally mounted between the uprights 22. A hollow steel inner tube 35 is fixed in coaxial alignment with the rotary table 33. A platform 36 is mounted on the rotary table 33 and incorporates vertical pins 37. A vacuum pipe 38 is attached to the underside of the channel base 21, and is in communication with the inside of the inner support 35 via a central passage through the rotary indexer table 33, table spacer 34 and platform 36. A comb holder 39 is attached to the shaft of each air cylinder 32 with a reinforcing bracket 40. Two adjustable stops 41 are attached to each comb holder 19, and arranged to abut the upright supports 22. A pin guide 42 with upper and lower spacers 43, 44 is provided on each side of the inner support 35. Additional pin guide spacers can be mounted through the upper and lower cross members 23, 24. A "comb" assembly 45 is clamped in each comb holder 39. Each comb assembly 45 has multiple solid pins spaced as required. Linear slides 46 are mounted on brackets 26 and secured to the ends of the comb holders 39, to maintain the combs 45 vertically aligned. Electrical "end" switches 55, 56 are mounted on brackets 27. A switch "trip" bar 47 is mounted on each linear slide 46 for actuating the switches. Tubing connects the filter/regulator/lubricator assembly 30 in series with the automatic valve 11 which is turn is connected to the air cylinders 32 in a parallel arrangement for control of a compressed air supply separately provided to the filter/regulator/lubricator assembly 30. A control box 48 with a power supply cord 49 houses a momentary start/resume switch 50, a momentary abort switch 51, an alarm buzzer 52 and an electrical power rectifier and transformer assembly 53. A commercially available indexer module 54 is electrically connected with the control box components 49, 50, 51, 52, 53, the end switches 55, 56 and the automatic air valve 31 per the wiring arrangement of FIG. 5.

Orientation and geometric inter-relation of components is further described as follows. The central vertical axis of the rotary indexer table 33, table spacer 34, inner support 35 and upper collar 28 is the focal axis to which all components reference. The uprights 22 are equidistant from the focal axis with inner facing surfaces tangentially oriented, and diametrically opposed except for a circumferential offset equal to the circumferential spacing of adjacent lateral rows of burner ports. The pins of the two comb assemblies 45 are axially offset by half the spacing of the pins, to give a staggered port array. The air cylinders 32, comb holders 39, comb assemblies 45, linear slides 46 and pin guides 42 are all in radial alignment with their respective uprights 42. The air cylinders 32 move the comb holders 39 and comb assemblies 45 back and forth along their respective radial axis. The linear slides 46 maintain the vertical alignment of the comb assemblies 45 and comb holders 39. The comb holder stops 41 limit the travel of the air cylinder 32 shafts. The pin guides 42 have a vertical column of holes through which the pins of the comb assemblies 45 reciprocate with the shaft motion of the air cylinders 32. The inner support 35 has a vertical column of holes, indicated schematically at 60, on each side in radial alignment with the air cylinders 32 at vertical spacings equal to the pin spacing of the comb assemblies 45. The pins of the comb assemblies 45 mate with the holes in the inner support 35 when shaft motion of the air cylinders 32 advances the comb holders 39 and the comb assemblies 45 toward the focal axis. The top edge of the inner support is serrated, as shown as 62. The upper cross members 23 minimize cantilever flexing of the uprights 22 and provide mounting for the front and rear upper pin guide spacers 44.

Figure 5:
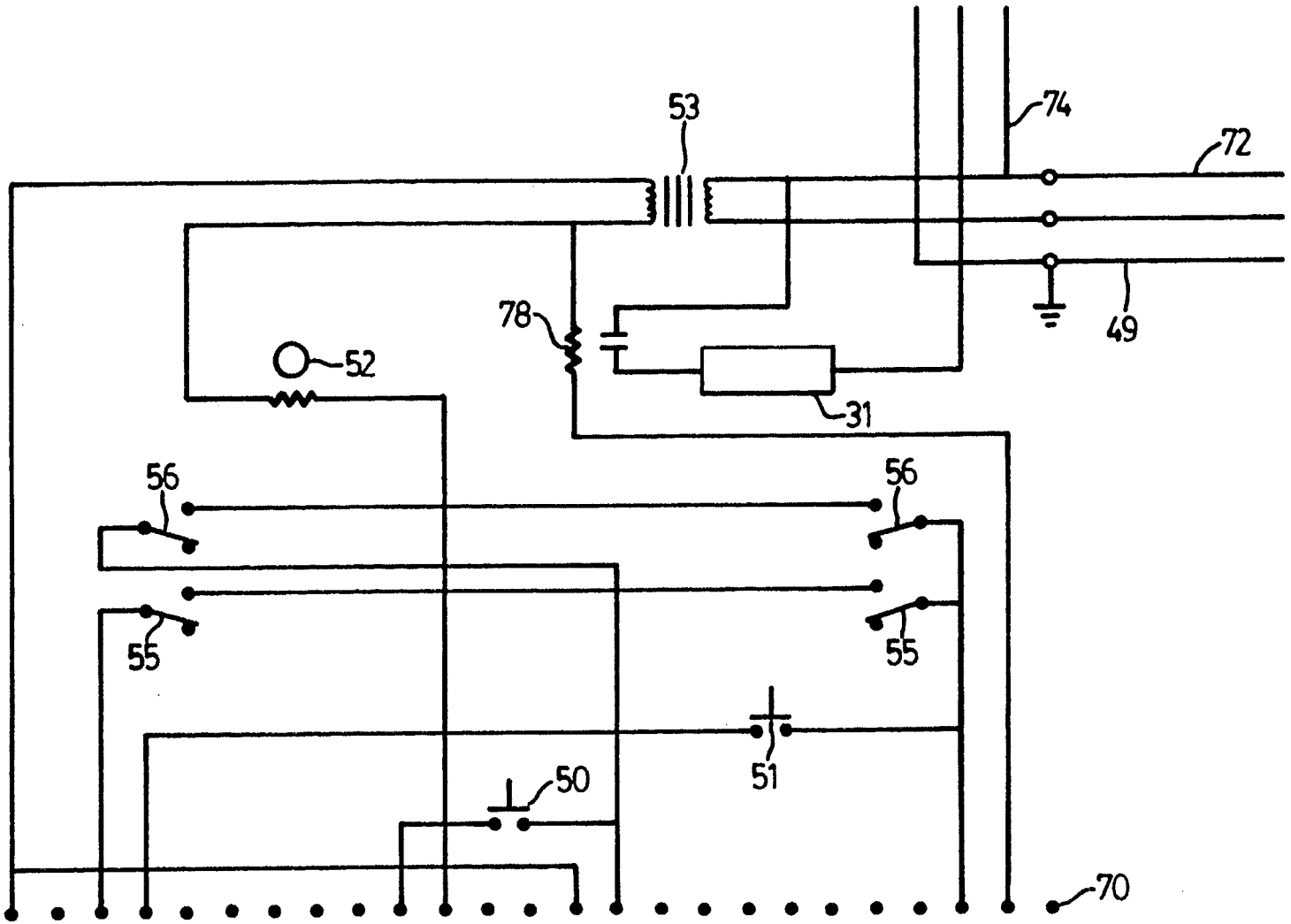

Referring to FIG. 5, this shows an electrical schematic of the connections to the indexer controller 54. A parallel input/output connection to the indexer 54 is shown at 70, and in known manner, comprises 25 pins of a "D" type male plug. An input for 120 volt AC supply is shown at 72, with a branch connection at 74 for the indexer 54. The transformer 53 provides a 24 volt DC power supply. The air control valve 31 is connected between the supply lines.

As shown, the DC output of the transformer 76 is connected to the connector 70, for supplying power to the indexer controller 54. The end or limit switches 55, 56 are connected as shown, and are shown in the open positions indicating no limit position reached. The cycle abort switch 51 and the cycle momentary start/resume switch 50 are connected as shown. The alarm buzzer 52 provides at least a 600 ohm resistance is connected to the connector 70 as shown. A relay 78, also providing at least a 600 ohm resistance is connected to the connector 70 for actuating contacts to supply power to the air control valve 51.

The operation of this preferred embodiment of the perforator apparatus will now be described. With the air cylinders 32 in a retracted position, an operator manually removes the weighted cap 29 and lowers a burner blank, indicated at 64 (and shown in section) down through the upper collar 28. The burner blank 64 is slid down around the inner support 35 with a reciprocating rotatory action if necessary so that the serrated upper edge of the inner support 35 removes any excess material on the inside diameter of the burner blank 64. This ensures as tight a fit between the inner support 35 and the burner blank as possible. The burner blank 64 is pressed vertically downward onto the indexer table platform 36 so that the vertical pins 37 fully penetrate the burner blank 64. These pins 37 maintain angular alignment of the burner blank 64 with the rotary indexer table 33. The weighted cap 29 is replaced and ideally fits snugly over the closed end of the burner blank, removing excess material on the outer diameter if necessary, to maintain vertical alignment of the burner blank and prevent the burner blank rising up off of the rotary table platform 36. In known manner, external connections of electrical power, compressed air and optional vacuum (now shown) are made. The compressed air supply is connected to the filter/regulator/lubricator assembly 30 and through control of the automatic valve 31 provides the motive force to push the pins of the comb assemblies through the walls of the burner blank 64 and subsequently retract them. Upon connection, the compressed air immediately passes through the automatic valve 31 to the shaft end of the air cylinders 32 to position the comb assemblies 45 in their retracted position. The momentary start/resume switch 50 initiates sequential control of all automated functions which is performed by the commercially available indexer module 54. A variety of functions can be programmed.

The primary functions begin with checking of the retracted position end switches 55 (FIG. 5). If the comb holders 39, hence the comb assemblies 45, are in their fully retracted positions, the trip bars 47 on the lower linear slides 46 will cause the retracted position end switches 55 to electrically signal the indexer module 54. If full retraction of both comb assemblies 45 is confirmed, the automatic air valve 31 is activated which switches the compressed air to the non-shaft end of the air cylinders 32. This causes the shaft of the air cylinders 32 to advance and push the pins of the comb assemblies 45 through the walls of the burner blank 64. If the pins of the comb assemblies 45 fully penetrate the walls of the burner blank and properly mate with the mating holes in the inner support 35, then the trip bars 47 on the lower linear slides 46 cause the forward position end switches 56 to electrically signal the indexer module 54. If full advance of both comb assemblies 45 is confirmed by closure of both switches 56, the automatic valve 31 is switched back so that compressed air is passed to the shaft end of the air cylinders 32 which causes the comb assemblies 45 to return to the retracted position. The retracted position and switches 55 are again checked to confirm full retraction of both comb assemblies 45. If confirmed, the rotary indexer table 33 is activated to rotate the burner blank through the desired number of degrees. The sequence described continues until a full rotation and hence complete perforation of the burner blank has been obtained. Should the full retracted or advanced positions fail to be signalled to the indexer module 54 by the end switches 55, 56, the indexer module 54 is programmed to halt sequencing and activate the alarm buzzer 52. The momentary start/resume switch 50 enables the operator to resume the perforation process after correction of the malfunction. The momentary abort switch 51 enables the operator to irretrievably halt the sequencing at any time.

The total angle through which the indexing table 36 needs to turn will depend upon the alignment of the two comb assemblies 45. Where staggered ports 18 are required, for example as shown in FIG. 2, then two different comb assemblies 45 are used, with their individual pins axially offset by an amount equal to half the pin spacing, as noted above. Then, the indexer table 33 is rotated through a full 360° . Additionally, an angular offset is provided for one of the combs 45, so that the holes punched by it are both axially and circumferentially spaced from the holes punched by the other comb assembly 45.

Where it is not required to provide a staggered perforated holes, the comb assemblies 45 can be configured to provide sets of holes in essentially the same location, along the axial length of a burner, and be exactly diametrically opposed. Then, each assembly 45 will perforate the holes for half of the burner blank 64, and it is only necessary for it to rotate through 180°.

It is preferred for the spacing of the ports or passageways 18 to be at least four times the port diameter, to ensure adequate supporting material around each port, during the punching operation.

Three separate embodiments of the invented fiber burner have been made and tested in controlled laboratory conditions since April 1984. All three embodiments utilize cylindrical geometry with one closed end as shown in FIG. 1, but are of different dimensions and utilize two different fiber densities.

The smallest embodiment measured nominally 3 inch (7.6 cm) outside diameter by 2 inch (5.1 cm) inside diameter by 6½ inch (16.5 cm) outside length. Samples of this embodiment were operated to determine long term durability. One sample was cycled through more than 7,600 cycles and amassed over 1,800 operating hours. Another sample was operated on a primarily continuous basis for over 2,200 hours. Neither sample showed any major deterioration.

The largest embodiment measured nominally 6 inch (15.2 cm) outside diameter by 4 inch (10.2 cm) inside diameter by 16 inch (40.6 cm) outside length. A sample of this embodiment has been tested in a boiler during the heating seasons of 1986–87 and 1987–88 amassing over 6,300 operating hours. This embodiment has shown the capability of being operable over a range of energy input from 100,000 to 1,500,000 BTU/Hr (29.3 to 439.3 kW).

I claim:

1. A method of forming a burner for a gaseous mixture of a fuel and an oxidant, the method comprising:

(a) forming a random mixture of refractory fibers, comprising predominantly alumina and silica;

(b) forming a burner body from the fiber mix of a predetermined shape including an inlet for a fuel and oxidant mixture;

(c) treating the burner body with colloidal silica and subsequently baking the burner body to bond and preshrink the fibers; and (d) forming passageways in the burner body, by perforating the burner body with pin means solely by punching.

2. A method as claimed in claim 1, wherein the fibers have a composition comprising, by weight:

| | |
|---|---|
| ferric oxide | 0.53–0.97; |
| titanium oxide | 0.70–1.27; |
| calcium oxide | 0.04–0.07; |
| alkalies | 0.08–0.15; |
| boron oxide | 0.03–0.06; |

with the balance comprising alumina and silica, optionally with trace quantities of magnesium oxide.

3. A method as claimed in claim 2, wherein the random mix of refractory fibers is formed with a density in a range 14 to 28 pounds per cubic foot.

4. A method as claimed in claim 3, wherein following step (c), the burner body is treated with a solution of colloidal silica and subsequently dried.

5. A method as claimed in claim 1, wherein following step (b), the burner body is baked at a temperature of at least 538° C., to eliminate any residual organic material.

6. A method as claimed in claim 5, wherein between steps (b) and (c), the burner body is treated with a solution of colloidal silica, containing up to 20% colloidal silica, and is subsequently baked at a temperature of at least 1,093° C., to bond and preshrink the fibers.

7. A method of forming a burner for a gaseous mixture of a fuel and an oxidant, the method comprising:

(a) forming a random mixture of refractory fibers, comprising predominantly alumina and silica;

(b) forming a burner body from the fiber mix of a predetermined shape including an inlet for a fuel and oxidant mixture;

(c) forming a plurality of passageways in the body, by perforating the burner body with a pair of comb assemblies, each of which comprises a plurality of generally parallel pins, wherein the comb assemblies are pressed into the burner body from generally opposite sides thereof so as simultaneously to form the plurality of passageways.

8. A method as claimed in claim 7, wherein the burner body is generally cylindrical and includes a longitudinal axis, and wherein the comb assemblies are aligned substantially parallel with the axis of the burner body and, in step (c), are pressed into the burner body from substantially diametrically opposite sides thereof.

9. A method as claimed in claim 8, wherein, in step (c), an inner support is provided within the burner body.

10. A method as claimed in claim 9, wherein the inner support includes a plurality of holes, aligned with the pins of the comb assemblies, for receiving the pins after passage through the burner body.

11. A method as claimed in claim 10, wherein, during step (c), for each comb assembly, a pin guide is provided having a plurality of holes through which the pins pass, with the pin guides being located adjacent the surface of the burner body to guide the pins.

12. A method as claimed in claim 11, wherein the burner body is treated with a mixture of colloidal silica after at least one of steps (b) and (c), treatment after step (b) being effected before step (c).

13. A method as claimed in claim 12, wherein after treatment with colloidal silica, the burner body is baked at an elevated temperature.

14. A method as claimed in claim 10, wherein step (c) comprises the following individual steps:

(i) pressing the comb assemblies through the burner body to form passageways therethrough;

(ii) withdrawing the comb assemblies from the burner body;

(iii) indexing the burner body through a preset angular amount;

(iv) repeating steps (i) - (iii) until the desired number of passageways have been formed.

15. A method as claimed in claim 14, wherein one comb assembly is axially and circumferentially offset relative to the other comb assembly, to enable axially spaced rows of passageways to be formed, with each row being staggered axially relative to adjacent rows.

16. A method as claimed in claim 15, wherein, for indexing, the burner body is mounted on an indexing table, and is maintained in angular alignment with the indexing table by mounting pins, and an axial end load is applied to the burner body to maintain it in engagement with the indexing table.

17. A method as claimed in claim 16, wherein the inner support includes a serrated free end over which the burner body is placed, for removing interfering material from the interior of the burner body, to ensure a close fit with the burner body.

18. A method as claimed in claim 7, wherein in step (b), the burner body is formed by vacuum forming.

* * * * *